US005105754A

United States Patent [19]

Collins

[11] Patent Number: 5,105,754

[45] Date of Patent: Apr. 21, 1992

[54] BOAT SKI RACK APPARATUS

[76] Inventor: Lonnie M. Collins, 4143 Beebe Cir., San Jose, Calif. 95135

[21] Appl. No.: 723,768

[22] Filed: Jul. 1, 1991

[51] Int. Cl.[5] ..... B63B 17/00

[52] U.S. Cl. ..... 114/343; 114/364; 224/42.45 R; 224/917; 211/70.5

[58] Field of Search ..... 114/343, 362, 364; 224/917, 42.07, 42.45 R; 441/79; 440/104, 109; 211/70.5, 70.8

[56] References Cited

U.S. PATENT DOCUMENTS

| | | | |
|---|---|---|---|
| 3,811,143 | 5/1974 | Page | 114/343 |
| 3,925,836 | 12/1975 | Simmonds | 114/364 |
| 4,582,015 | 4/1986 | Hunter | 114/364 |
| 4,858,802 | 8/1989 | Hamby et al. | 114/364 |
| 4,863,082 | 9/1989 | Evans et al. | 114/364 |
| 4,874,120 | 10/1989 | Paton et al. | 114/343 |

*Primary Examiner*—Jesus D. Sotelo
*Assistant Examiner*—Stephen P. Avila
*Attorney, Agent, or Firm*—Leon Gilden

[57] ABSTRACT

An apparatus is utilized in combination with an engine of an associated water craft to include a rear and forward rack member mounted to respective rear and forward end walls of the engine. The rack members include support legs directed downwardly therefrom, wherein the rear member includes a plural pair of support legs to provide rigidity to the organization, wherein the support legs and support plate of the rear rack member are radially mounted about a central hub, with the central hub including a tow hook medially thereof for use in towing of a skier utilizing the water skis secured by the apparatus. Further, the organization includes unitary individual mounts slidably and frictionally engaged within the support plates for ease of mounting of ski pairs onto the structure.

5 Claims, 4 Drawing Sheets

PRIOR ART

BOAT SKI RACK APPARATUS

BACKGROUND OF THE INVENTION

1. Field of the Invention

The field of invention relates to boat ski apparatus, and more particularly pertains to a new and improved boat ski rack apparatus wherein the same is arranged for mounting relative to an engine housing cover.

2. Description of the Prior Art

Ski racks of various types are utilized in the prior art for mounting of skis utilized in water skiing events. Such water skis are of a typically cumbersome construction, wherein mounting of such ski racks relative to boats for storage is useful to prevent damage and theft of such apparatus, particularly when such skis are left ashore. Further, stability of the organization is important in providing rigidity and geometric integrity in the mounting and positioning of skis. Examples of prior art devices include U.S. Pat. No. 4,582,015 to Hunter wherein a water ski rack includes structure to position the rack structure exteriorly of a boat hull.

U.S. Pat. No. 4,858,802 to Hamby, et al. sets forth water ski storage for use in a boat, wherein the structure is mounted to a rear deck area of a boat for mounting the skis within an ape of generally "Y" shaped structure.

U.S. Pat. No. 4,330,065 to Haddad sets forth a portable ski rack apparatus arranged for portability in the mounting relative to a boat structure.

As such, it may be appreciated that there continues to be a need for a new and improved boat ski rack apparatus as set forth by the instant invention which addresses both the problems of ease of use as well as effectiveness in construction in providing a stable and secure mounting of water skis relative to a boat hull and in this respect, the present invention substantially fulfills this need.

SUMMARY OF THE INVENTION

In view of the foregoing disadvantages inherent in the known types of ski rack storage apparatus for boats now present in the prior art, the present invention provides a boat ski rack apparatus wherein the same is arranged for mounting relative to an engine of a boat. As such, the general purpose of the present invention, which will be described subsequently in greater detail, is to provide a new and improved boat ski rack apparatus which has all the advantages of the prior art boat ski rack apparatus and none of the disadvantages.

To attain this, the present invention provides an apparatus utilized in combination with a engine of an associated water craft to include a rear and forward rack member mounted to respective rear and forward end walls of the engine cover. The rack members include support legs directed downwardly therefrom, wherein the rear member includes a plural pair of support legs to provide rigidity to the organization wherein the support legs and support plate of the rear rack member are radially mounted about a central hub, with the central hub including a tow hook medially thereof for use in towing of a skier utilizing the water skis secured by the apparatus. Further, the organization includes unitary individual mounts slidably and frictionally engaged within the support plates for ease of mounting of ski pairs onto the structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way It is therefore an object of the present invention to provide a new and improved boat ski rack apparatus which has all the advantages of the prior art boat ski rack apparatus and none of the disadvantages.

It is another object of the present invention to provide a new and improved boat ski rack apparatus which may be easily and efficiently manufactured and marketed.

It is a further object of the present invention to provide a new and improved boat ski rack apparatus which is of a durable and reliable construction.

An even further object of the present invention is to provide a new and improved boat ski rack apparatus which is susceptible of a low cost of manufacture with regard to both materials and labor, and which accordingly is then susceptible of low prices of sale to the consuming public, thereby making such boat ski rack apparatus economically available to the buying public.

Still yet another object of the present invention is to provide a new and improved boat ski rack apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
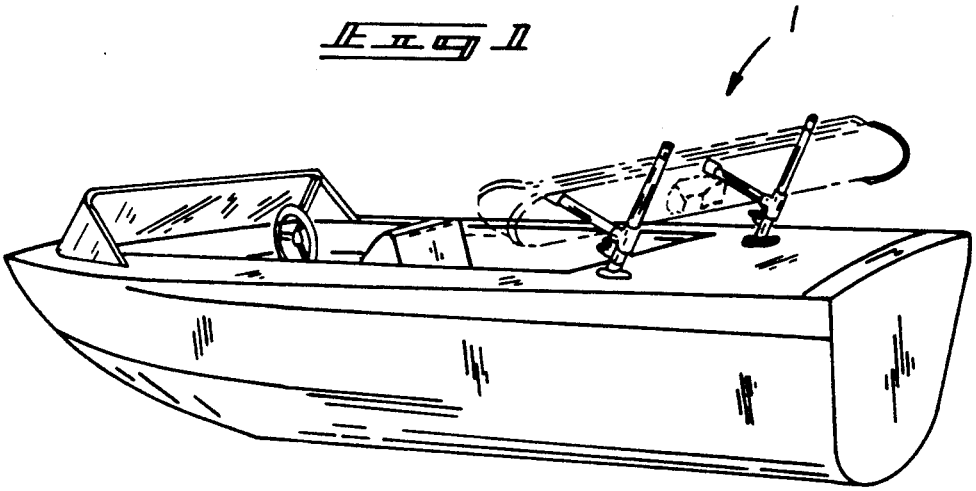
FIG. 1 is an isometric illustration of a prior art ski rack apparatus.
Figure 2:
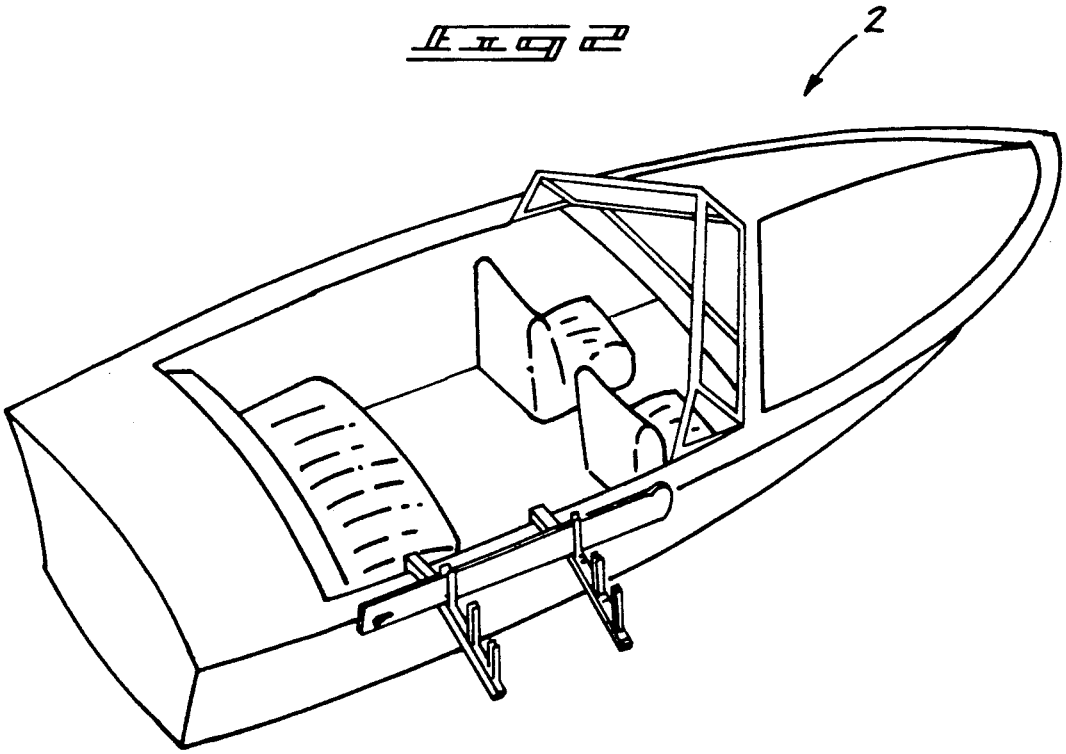
PRIOR ART Fig 2
FIG. 2 is an isometric illustration of a further prior art boat ski rack structure.
Figure 3:
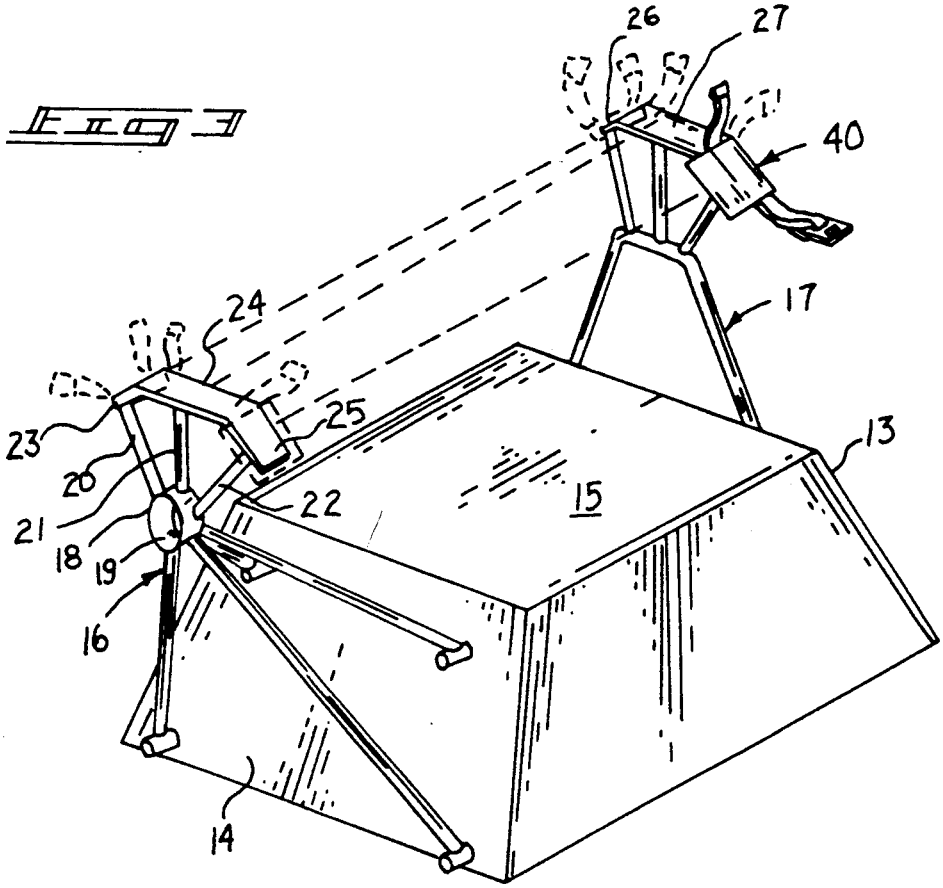
FIG. 3 is an isometric illustration of the invention mounted relative to an associated engine cover of a boat.

With reference now to the drawings, and in particular to FIGS. 1 to 9 thereof, a new and improved boat ski rack apparatus embodying the principles and concepts of the present invention and generally designated by the reference numeral 10 will be described FIG. 1 illustrates a prior art boat ski rack structure, as set forth in U.S. Pat. No. 4,858,802, wherein "Y" shaped support racks mount a plurality of skis therebetween. FIG. 2 illustrates a further prior art structure, as set forth in U.S. Pat. No. 4,582,015, wherein the rack structure is directed exteriorly of the boat hull for the mounting of ski racks therewithin.

Figure 9:
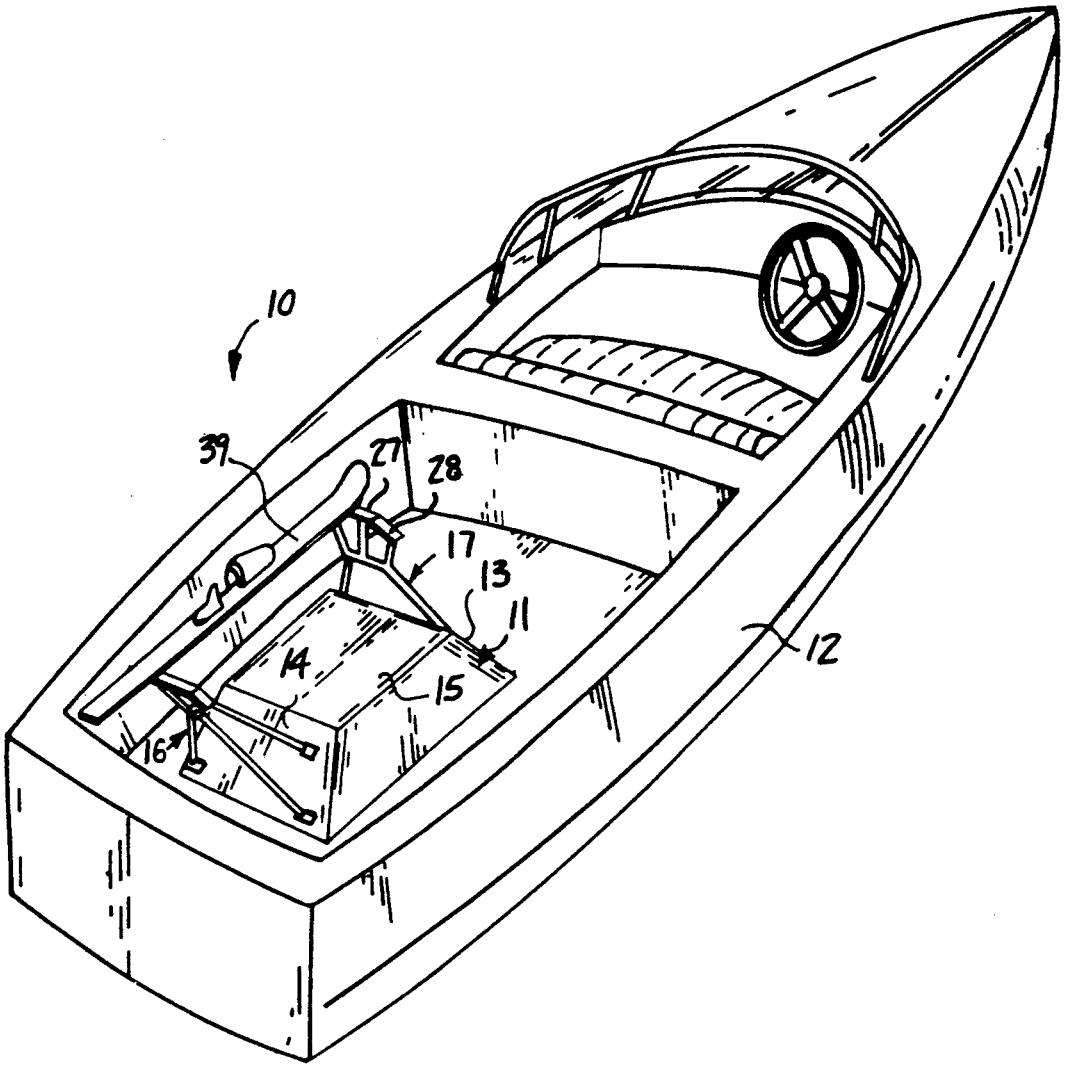
FIG. 9 is an isometric illustration of the invention mounted within an associated boat hull.

More specifically, the boat ski rack apparatus 10 of the instant invention essentially comprises a rear rack member 16 positioned rearwardly of a forward rack member 17 that are mounted to respective rear and forward engine cover walls 14 and 13 respectively of an associated engine cover or engine 11. The rear and forward rack members 16 and 17 are arranged for mounting a single or plurality of water skis 39 to extend above the engine or cover top wall 15, as illustrated in FIG. 9, that is mounted within the boat hull 12. The rear rack member 16 includes a central hub 18. A tow ring 19 is mounted vertically and diametrically within the central hub 18 for the mounting of a tow rope for the towing of an individual engaged in a water skiing event rearwardly of the boat hull 12. The central hub 11 includes a respective first, second, and third radial support rib 20, 21, and 22 respectively that are radially directed from the hub 18 in a singular annular plane. A respective first, second, and third rear mounting plate 23, 24, and 25 are orthogonally mounted to upper terminal ends of each of the respective first, second, and third support ribs 20, 21, and 22. The mounting plates are in contiguous relationship relative to one another and define a generally inverted "C" shaped configuration. The rear mounting plates 23, 24, and 25 are each aligned with a respective first, second, and third front mounting plate 26, 27, and 28. The front mounting plates are mounted to upper terminal ends of a respective first, second, and third frontal support rib 29, 30, and 31 mounted to a single support bar 32. The support bar 32 includes a respective first and second frontal support leg 33 and 34 extending downwardly from the frontal support bar 32 mounted to the engine or cover forward wall 13. The rear rack member 16 requires extra stressing to accommodate the towing of a individual by the tow ring 19 and utilizes a respective first and second rear support rear leg 35 and 36 that are mounted to the engine or cover rear wall 14. A rear support first and second front leg 37 and 38 positioned forwardly of each respective rear support first and second rear leg 35 and 36, also mounted to the engine or cover rear wall 14. In this manner, each of the respective pairs of first, second, and third mounting plates of the rear and forward rack members support an individual water ski thereon. Further, each of the mounting plates are arranged for use with a strap pair, as illustrated in phantom in FIG. 3, for securing a water ski to each mounting plate.

Figure 4:
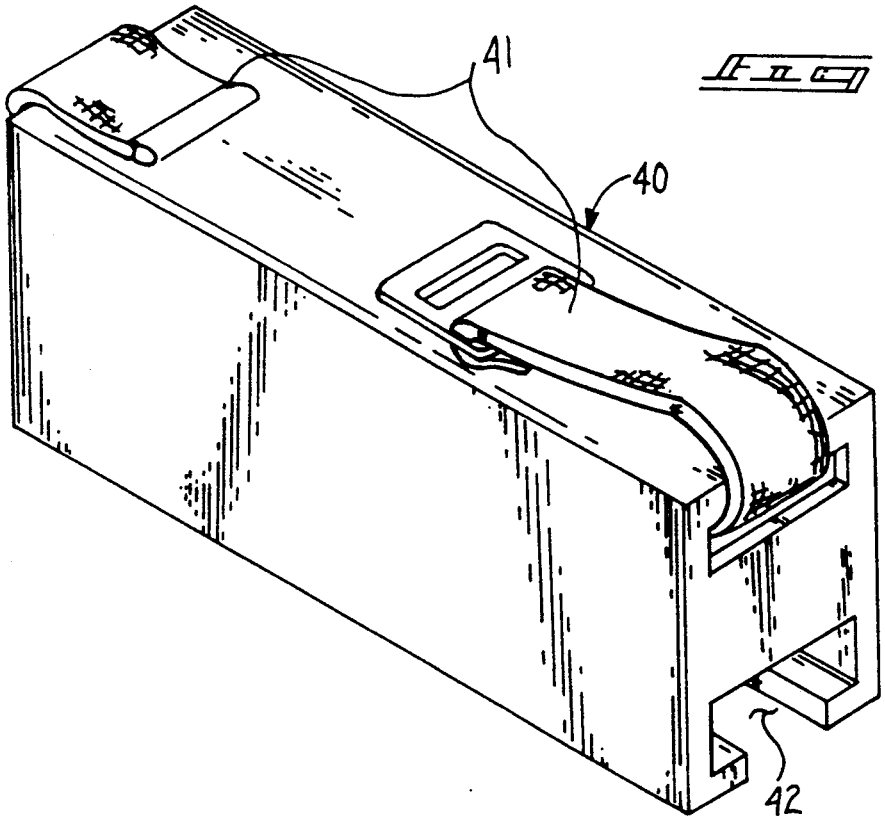
FIG. 4 is an isometric illustration of a slide-on mount for use with the mounting plates of the invention as depicted in FIG. 3.
Figure 5:
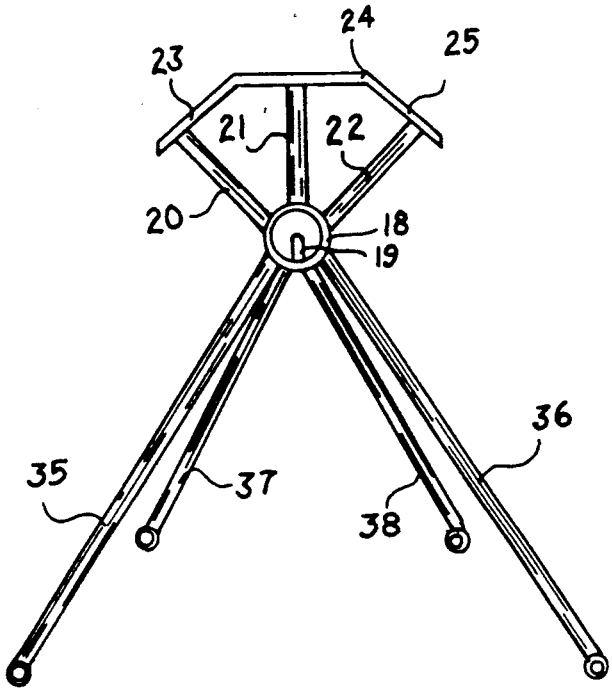
FIG. 5 is an orthographic rear view of the rear rack member.
Figure 6:
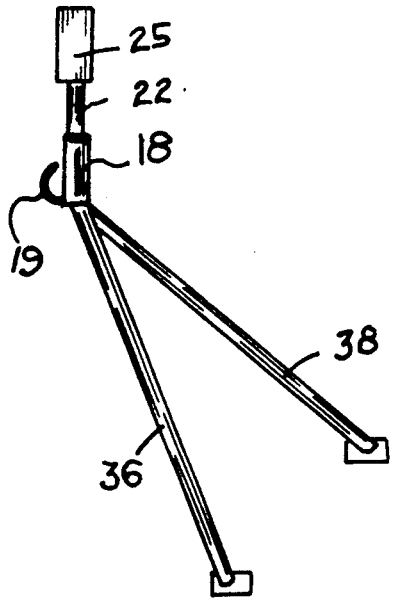
FIG. 6 is an orthographic side view of the rear rack member.
Figure 7:
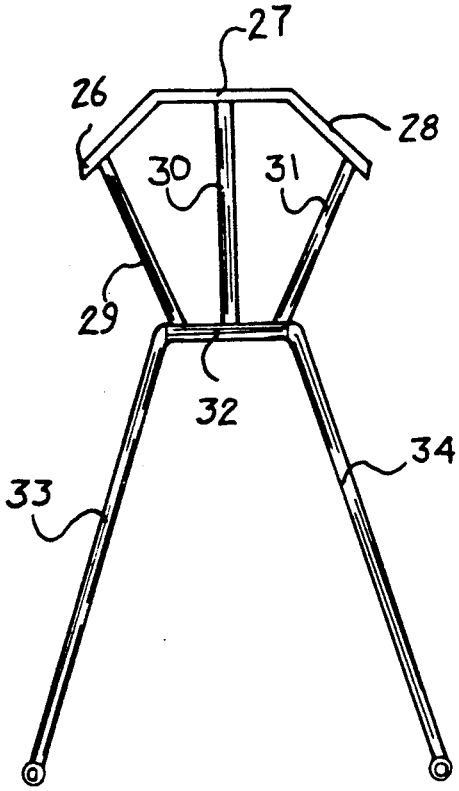
FIG. 7 is an orthographic frontal view of the forward rack member.
Figure 8:
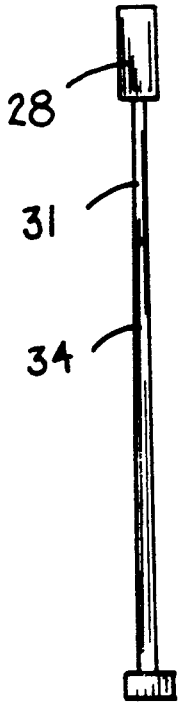
FIG. 8 is an orthographic side view of the frontal rack member.

A slide-on mount 40, as illustrated in FIG. 4, is utilized that includes a further strap pair 41. A plurality of such slide-on mounts 40 may be utilized, wherein water skis may be additionally mounted on the slide-on mounts and then secured on respective pairs of first and third mounting plates. The mount 40 includes a "T" shaped slot 42 defined by a predetermined cross-sectional configuration substantially equalling that of the individual mounting plates for frictionally receiving and securing a mounting plate within a "T" shaped slot 42, if desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling which the scope of the invention.

What is claimed as being new and desired to be protected by Letters Patent of the United States is as follows:

1. A boat ski rack apparatus for securement within a boat hull, wherein the boat hull includes an engine cover, the engine cover including a forward wall spaced from a rear wall, and the apparatus includes, a rear rack member mounted to the rear wall, and a forward rack member mounted to the forward wall, and the rear rack member including a first rear mounting plate contiguously mounted to a second rear mounting plate, wherein the second rear mounting plate is mounted to a third rear mounting plate, and the first rear mounting plate, the second rear mounting plate, and the third rear mounting plate defining a "C" shaped configuration, and the forward rack member includes a front mounting plate contiguously mounted to a second front mounting plate, the second front mounting plate mounted to a third front mounting plate, and the first front mounting plate, the second front mounting plate, and the third front mounting plate define a configuration equal to the "C" shaped configuration, and wherein the first rear mounting plate and the first front mounting plate are coplanar, the second rear mounting plate and the second front mounting plate are coplanar, and the third rear mounting plate and the third front mounting plate are coplanar, and wherein the rear rack member includes a central hub, the central hum includes a tow ring diametrically directed within the central hub for securement of a tow rope thereto, and the central hub including a first radial support rib, a second radial support rib, and a third radial support rib radially directed into the central hub within a single annular plane, and the first radial support rib fixedly and orthogonally mounting the first rear mounting plate to an upper terminal end thereof, and the second radial support rib fixedly and orthogonally mounting the second rear mounting plate to an upper terminal end thereof, and the third radial support rib fixedly and orthogonally mounting the third rear mounting plate to an upper terminal end thereof.

2. An apparatus as set forth in claim 1 wherein the central hub includes a first support leg pair and a second support leg pair mounted to the central hub, wherein the first support leg pair and the second support leg pair are fixedly mounted to the rear wall of the engine cover.

3. An apparatus as set forth in claim 2 wherein the forward rack member includes a first frontal support leg and a second frontal support leg, the first and second frontal support legs mounted to a support bar, and the support bar including a first frontal support rib, a second frontal support rib, and a third frontal support rib, the first frontal support rib mounting the first front mounting plate thereto, the second frontal support rib mounting the second front mounting plate thereto, and a third frontal support rib mounting the third mounting plate thereto.

4. An apparatus as set forth in claim 3 wherein each mounting plate includes a strap pair for securement of a water ski.

5. An apparatus as set forth in claim 4 wherein the apparatus further includes a slide mount, the slide mount including an elongate longitudinally aligned body mounting a further strap pair, and the elongate body includes a "T" shaped slot coextensively directed of the body, wherein the "T" shaped slot is defined by a predetermined cross-sectional configuration, and each respective mounting plate is defined by a cross-sectional configuration equal to the predetermined cross-sectional configuration.

* * * * *